United States Patent [19]

Hollrock

[11] Patent Number: 4,805,251

[45] Date of Patent: Feb. 21, 1989

[54] GOLF BALL WASHER

[75] Inventor: J. Richard Hollrock, Simsbury, Conn.

[73] Assignee: Hollrock Engineering, Inc., Granby, Conn.

[21] Appl. No.: 57,322

[22] Filed: Jun. 2, 1987

[51] Int. Cl.[4] ..... A63B 47/04

[52] U.S. Cl. ..... 15/21 A; 15/3.13

[58] Field of Search ..... 15/21 A, 97 R, 3.13, 15/3.14, 3.15, 3.16, 3.19, 3.2; 134/132, 137

[56] References Cited

U.S. PATENT DOCUMENTS

| | | | |
|---|---|---|---|
| 1,798,322 | 3/1931 | Floyd et al. | 15/21 A |
| 1,954,738 | 4/1934 | Lerch | 15/21 A |
| 3,038,186 | 6/1962 | Davy | 15/21 A |
| 3,083,389 | 4/1963 | Witlek | 15/21 A |
| 3,099,027 | 7/1963 | Illo | 15/21 A |
| 3,120,669 | 2/1964 | Montuori | 15/97 R |
| 4,011,619 | 3/1977 | Michalak | 15/21 A |
| 4,181,996 | 1/1980 | Hollrock | 15/21 A |

*Primary Examiner*—Edward L. Roberts

*Attorney, Agent, or Firm*—McCormick, Paulding & Huber

[57] ABSTRACT

A golf ball washer has a cylindrical bristle brush rotatably supported in a rectangular tank to move the balls along a zig-zag dual track defined in the tank cover and in an insert provided in the tank. The balls move downwardly through a top opening in the cover and enter the dual track in end-to-end relationship. The track has segments oriented at oppositely inclined angles to abruptly shift the direction of motion of each ball and to accelerate each ball away from those following it.

19 Claims, 4 Drawing Sheets

GOLF BALL WASHER

BACKGROUND OF THE INVENTION

This invention relates generally to apparatus for washing golf balls or similar articles and deals more particularly with a ball washer of the type having a rotary brush turning on a horizontal axis so that the brush moves the balls from an inlet end of a solution filled tank structure toward an outlet end in an automatic mode of operation where the user need only fill a bin at the top of the washer with balls to be cleaned, the clean balls being ejected from the apparatus into a suitable receptacle.

SUMMARY OF THE INVENTION

In accordance with a preferred form of the present invention the ball washer includes a tank for containing a quantity of water or other cleaning solution and a semi-circular track defining insert is provided in the tank. The tank supported track defining means cooperates with another track defining segment in the tank cover. The tank cover is also semi-circular and is preferably hinged at the rear of the tank so that when closed the track defining segments in the tank insert and cover provide a path for the balls moved through the device by the periphery of the rotor brush.

The track segment in the tank insert includes at least first and second angularly related track segments that define a juncture therebetween in order that the balls travelling along the track be moved around a sharp angle at this juncture to improve the cleaning action thereof. More particularly, the first track segment traversed by the balls in the tank insert serves to advance the balls in one axial direction relative to the rotor axis of rotation while the second track segment provides an opposite component of ball movement relative to this axis. Further, these track segments are so angled as to gradually increase the speed of ball movement in these track segments to provide a separation between the balls as they move through the washer.

The cover forms a continuation for these first and second track segments and includes at least a third track segment provided at a helix angle to further increase the speed of the balls and thereby increase the separation between them just prior to exiting from the washer.

The track defining insert is readily removable being provided on locating pins defined in the tank structure itself, and the rotor also is readily removeable by mounting the bearings for the rotor on the same locating pins. A drive motor is coupled to the rotor by means of a drive and driven member which are also readily disassembled without necessity for removing fasteners or the like. This configuration provides for easier cleaning of the apparatus, and does not lead to the laborious disassembly normally required of ball washers of this type.

The track segments provided by the tank insert and cover preferably define a plurality of parallel or side by side paths, and chute means provided between the bin and an opening in the cover includes ball guiding means to prevent the balls from jamming in a chute provided between the storage bin and the track segments in the washer.

DETAILED DESCRIPTION OF PREFERRED EMBODIMENT

Figure 1:
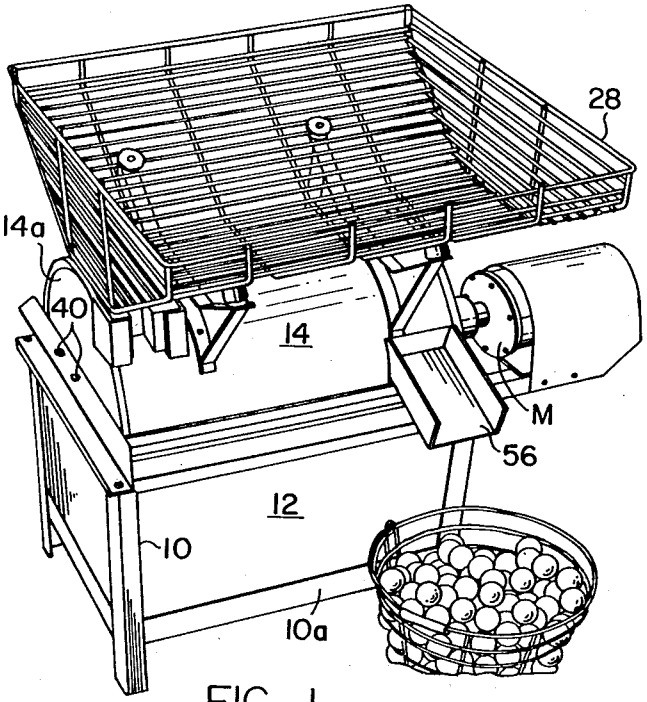
FIG. 1 is a top quartering perspective of a washer constructed in accordance with the present invention.

Turning now to the drawings in greater detail, FIG. 1 shows a ball washer of the type used to clean golf balls at a golfing driving range. The washer includes a generally rectangular frame 10 having four legs at the four corners of the generally rectangular frame, and the frame also includes horizontally extending end rails and front and rear members 10*a* and 10*b* which support a generally rectangular tank 12. The tank 12 is also rectangular and contains a quantity of washing solution, such as water and a suitable detergent.

Figure 3:
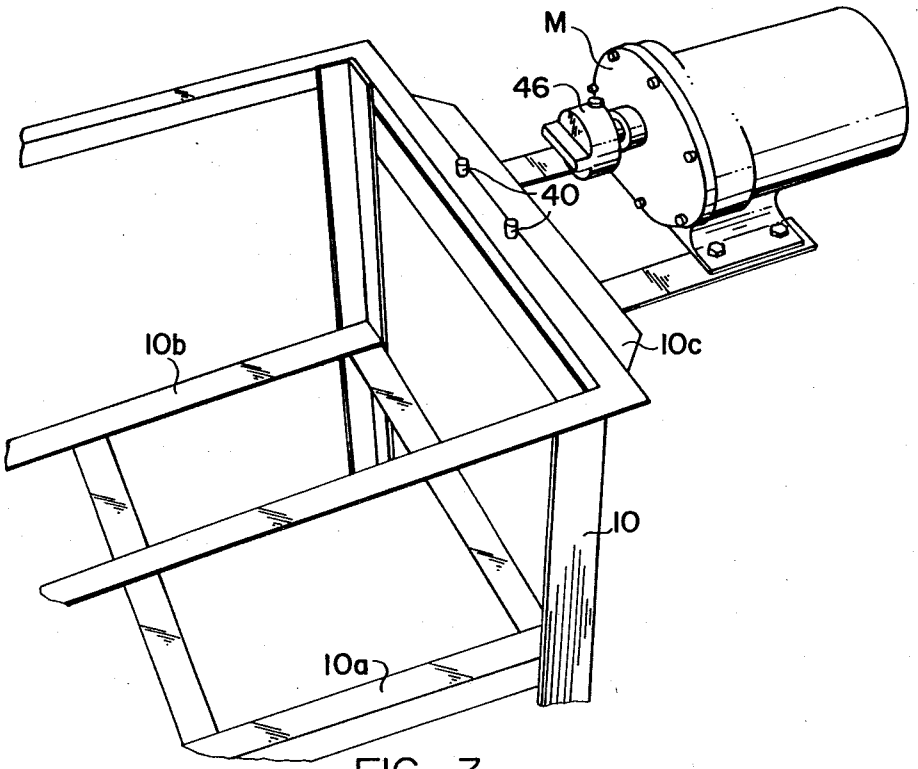
FIG. 3 is a top perspective view of the tank supporting structure and drive motor provided for turning the rotor in the washer of FIG. 1.

FIG. 3 shows the frame structure 10, and also a bracket 10*c* carried by an end member of the frame 10 for supporting a brush drive motor M.

Figure 4:
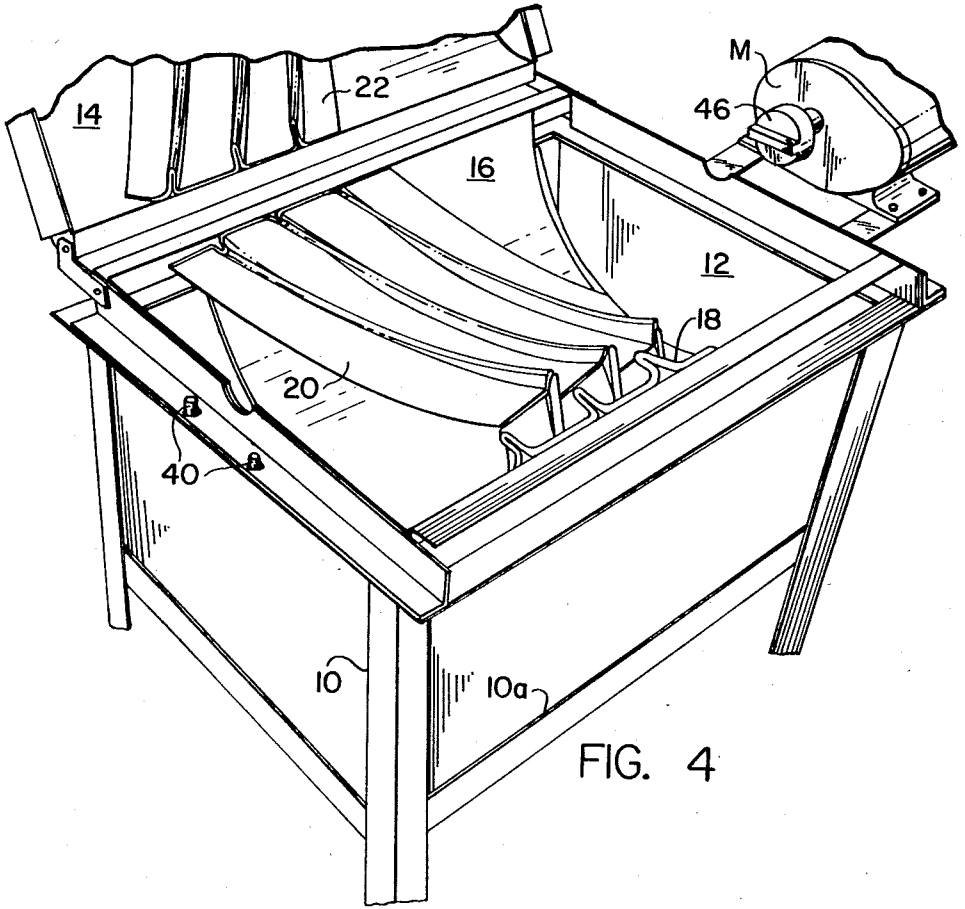
FIG. 4 is a top perspective view of the frame illustrated in FIG. 3 with the track defining insert provided therein, and with the hinged cover in place at the rear of this tank frame.
Figure 2:
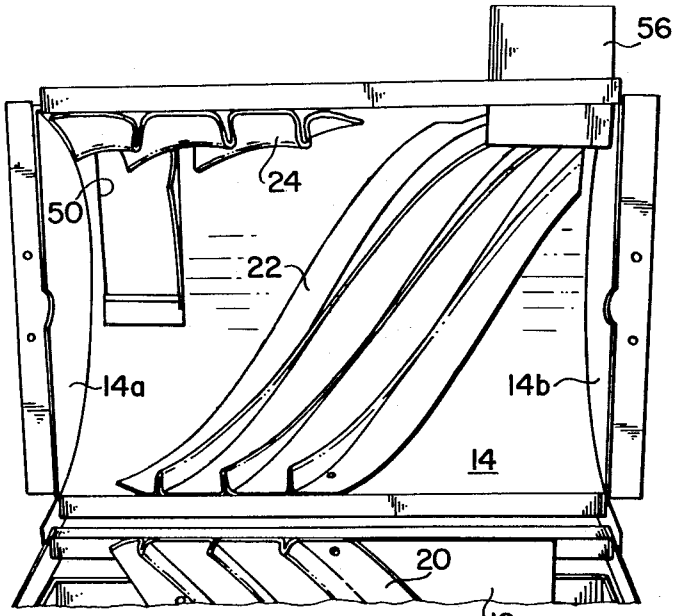
FIG. 2 is an elevational view illustrating the track defining portion of the hinged cover on the apparatus in FIG. 1.

A semi-circular cover 14 is hinged to the rear edge of the upwardly open tank 12, and the cover 14 is adapted to be moved from its closed position shown in FIG. 1 to a raised position as suggested in FIGS. 2 and 4. The tank 12 can be seen from FIG. 4 to be upwardly open and to be provided with a semi-circular track defining member 16 provided as an insert inside the tank 12 and adapted to be submersed in the solution provided within the tank 12 for cleaning the balls. The member 16 includes a semi-circular bent metal track supporting portion that is somewhat shorter than the overall length of the rectangular tank 12 in order that the solution be circulated in the tank so that a considerable quantity of foreign matter (usually stones and dirt or the like from the balls) can be accommodated in the tank 12 without necessity for replacing the washing solution. The semi-circular track defining member 16 also includes a generally rectangular supporting frame that corresponds in size and shape to the upwardly open rectangular frame 10 and this member 16 is provided on locating pins (to be described) so as to be readily removed without the necessity for manipulating fastening members or the like. The rear edge of this frame for member 16 carries a hinge, which hinge is also connected to the cover 14 in so that the cover can be pivoted from the closed position of FIG. 1 to the open position of FIG. 2.

The cover member 14 is semi-circular in configuration but unlike member 16 includes end walls 14*a* and 14*b* as best shown in FIG. 2. This cover 14 and insert member 16 cooperate with one another in the cover closed position to surround a rotary brush 34 best shown in FIG. 5 and 6.

Figure 5:
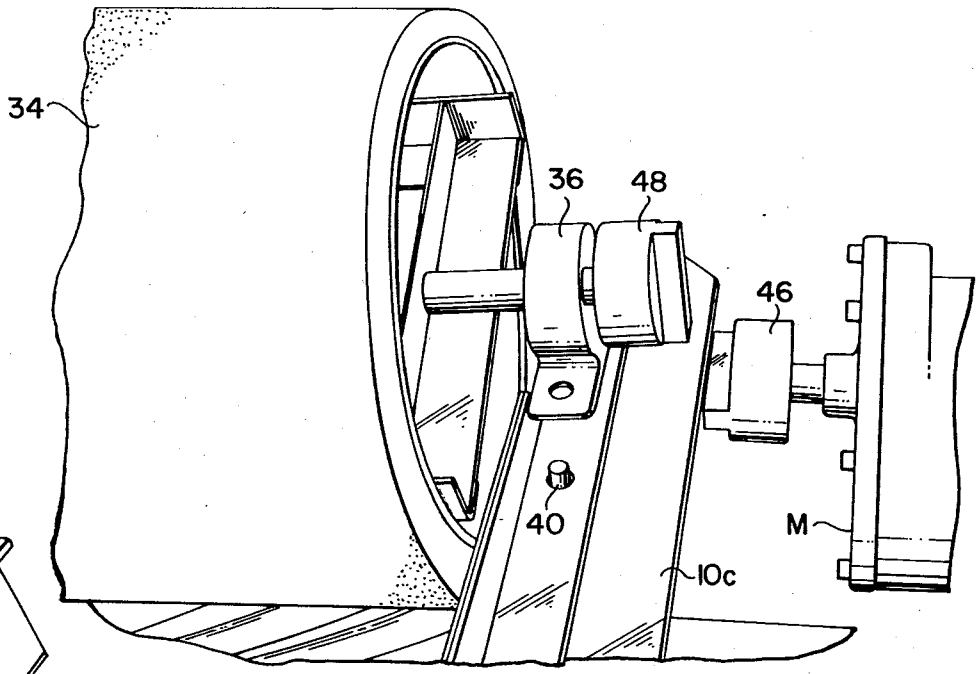
FIG. 5 is a perspective view illustrating one end portion of the rotor brush and its associated coupling means. The rotor and driven portion of the coupling is shown in a slightly raised position to illustrate how the brush is removed from the washer.
Figure 6:
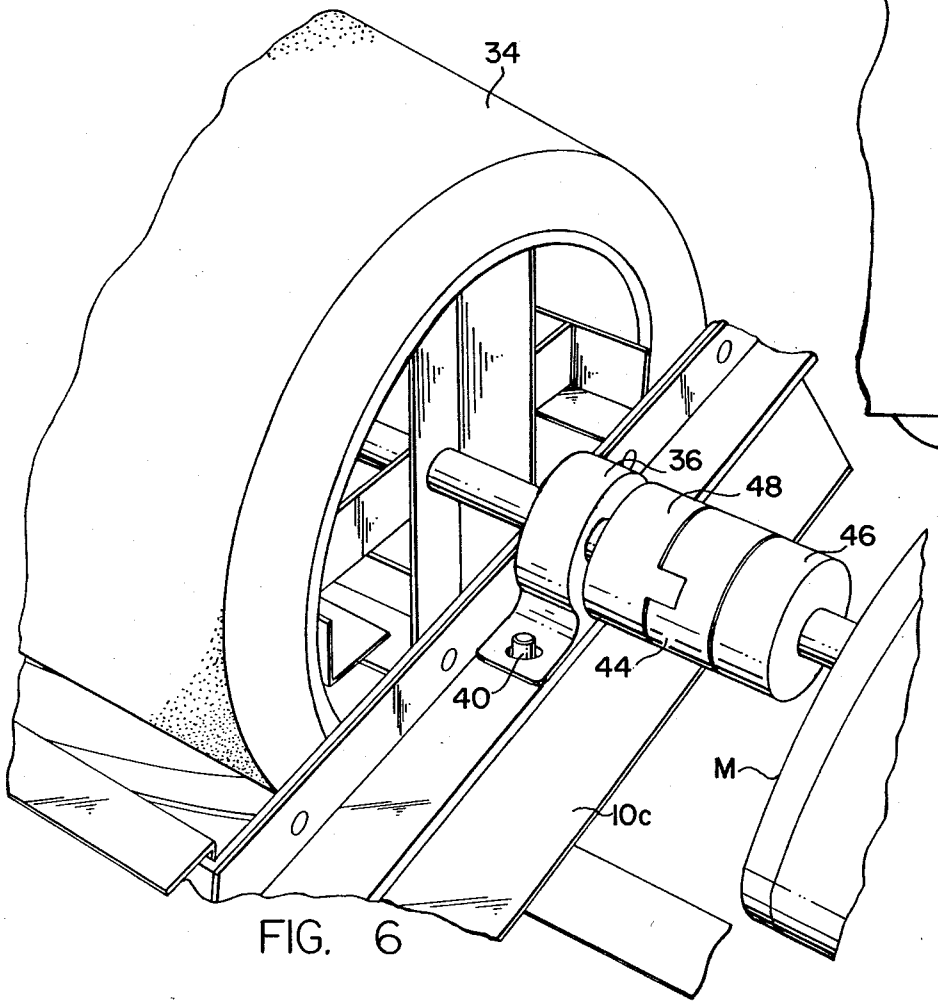
FIG. 6 shows the brush provided in assembled position in the tank, the drive coupling being drivingly connected to the motor and the journal bearing being located on the pins provided for this purpose in the tank.
Figure 8:
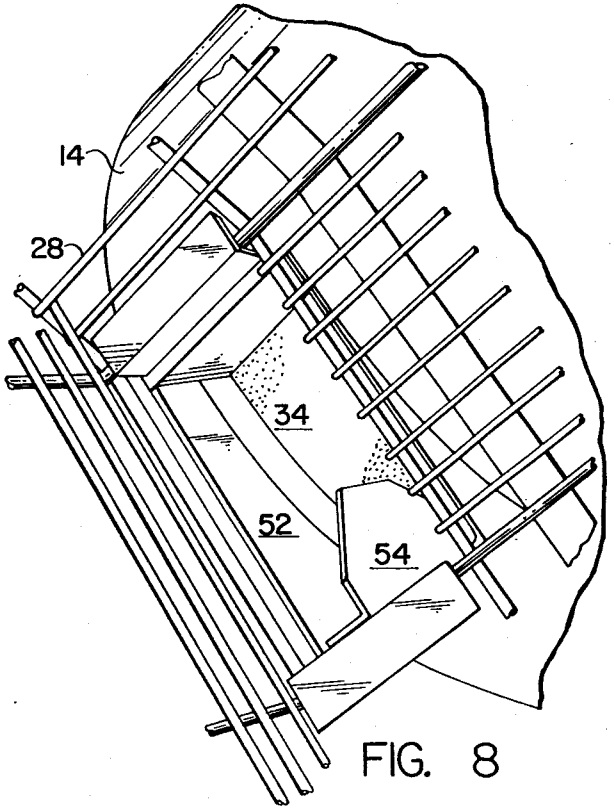
FIG. 8 is a view similar to FIG. 7 but taken from a slightly different vantage point.
Figure 7:
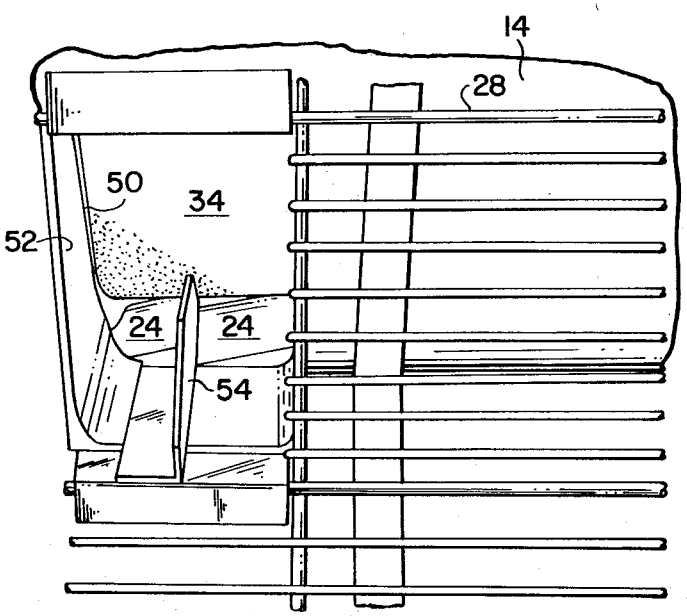
FIG. 7 is a top view of the chute provided for feeding balls from the storage bin into the washer via the cover opening.

The rotary brush 34 is supported on two journals, such as indicated generally at 36 in FIG. 5 and 6, and these journals are provided with mounting holes that fit onto locating pins provided for this purpose in the end rails 10*c* of the frame 10. The locating pins are best shown in FIG. 3, and the FIG. 5 position for the rotor 34 illustrates the journal bearing 36 in a raised position above its associated locating pins to illustrate the ease with which the rotor can be removed once the cover has been opened as described previously.

When in its normal position the brush 34 is coupled to the output shaft of the drive motor M by coupling means best shown in FIGS. 5 and 6. The coupling means is also readily disassembled comprising a drive and driven member (46 and 48) connected to one another by a plastic plug 44 having 90 degree offset diametrically extending grooves. for receiving ribs provided for this purpose on the drivand the driven member. The plastic block 44 has been omitted from FIG. 5 but is shown in FIG. 6 in position for coupling the output drive shaft from the motor M to a stub axle provided for this purpose in the brush rotor 34. The brush 34 is cylindrical in shape and includes bristles at its periphery that act on the golf balls being washed to cause the balls to travel around a predetermined path defined by track segments that are precisely located in both the inserts 16 and cover 14 in a manner to be described.

Golf balls to be washed are placed in a storage bin 28 mounted on top of the cover 14 and moveable with the cover as the cover is manually moved from its closed position of FIG. 1 to the open position of FIG. 2. The cover 14 includes a top center opening 50 through which the balls from the storage bin 28 are adapted to pass s they move by gravity downwardly onto the surface of the rotary brush 34 to be carried through the uniquely configured tracks to be described. The cover opening 50 is over an opening of similar size and shape in the bottom wall of the storage bin 28 by chute means 52 and the chute means nd cover opening 50 have generally rectangular shape with the width of this opening being roughly that of two diameter of the balls to be washed. A guide means 54 is provided in the chute means 52 in order to avoid nesting of the balls as they pass from the storage means 28 downwardly through the chute means 52 into the tracks provided for the balls inside the washer.

Turning next to a detailed description of the track defining section provided inside the washer and more particularly as defined by the insert member 16 and cover 14. FIG. 2 shows the cover 4 as including an inlet track segment 24 adapted to receive balls from the chute means 52 and to guide the balls from the left had end of the washer parallel the rotor axis and toward the right n FIGS. 1, 2 and 4. As the balls drop downwardly through the radially inwardly open grooves defined by the inlet track segment 24 they move in a generally spiral or helical path. The brush 34 will cause these balls to move in this direction and to enter a first track segment 18 that forms continuation of the generally helical path provided by the inlet track segment 2. The first track segment 18 cooperates with a second track segment 20 best shown in FIG. 4 to abruptly change the direction of movement of the balls at the juncture between these track segments 18 and 20. More specifically the balls horizontal component of motion as measured parallel the axis of the rotor, is changed from a left to right direction to a right to left direction-al component. The juncture is at the lowest point in the semi-circular support for track segments 18 and 20.

The balls will continue to move upwardly in the track segment 20 toward the upper edge of the insert member 16 where they then are again reversed in direction at a second juncture defined between the downstream end of the second track segment 20 and the upstream end of a third or upper track segment 22 best shown in FIG. 2. FIGS. 2 and 4 show the cover in its open position and with the rotor removed for clarity, but it will be understood that with the cover in its closed position and the rotor in place the golf balls will follow a tortuous path provided by the tack segments 18, 20 and 22, the balls being abruptly caused to change direction at the junctures between these track segments.

After the balls have been washed as above described they exit from the washer through exit chute 56 where they are gathered in buckets of the type generally used by golf driving ranges to provide clean golf balls for the customers.

In its presently preferred form the track defining segments provided in the insert 16 and cover 14 comprise vacuum molded component with conveyor belting material provided to increase the frition between the rolling ball and the track segment itself. Two side by side parallel paths are provided for the balls being dashed in order to improve the performance of the washer in terms of its capability in handling a maximum number of golf balls within a reasonable period of time. It is an important feature of the present invention that the track segments 18, 20 and 22 provide a changing helical pitch angle with respect to the axis of the motor to accelerate the movement of the balls in order to provide an increasing separation between the balls as they move from the entry end at the left hand cover opening through the washer to exit from the exit chute 56 at the right hand end. Thus, the track segment 22 defined inside the cover 14 has a helix angle that achieves the greatest horizontal or axial component of velocity for the ball whereas the inlet track segment and generally aligned first track segment, 24 and 18 respectively, achieve the least level of horizontal velocity component in the balls moved through these track segments by the rotating brush 34.

Another important feature of the present invention is the ease with which the apparatus can be cleaned and/or disassembed. Once the cover has been raised from the closed position to its pen position rotor 34 can be easily removed because it is held only by locating pins 40 provided at the left and right hand ends of the frame FIG. 3). No conventional fastening devices need be unscrewed or unfastened to permit removal of the rotor. Once the rotor has been removed the insert 16 provided in the tank 12 can also be removed in the same manner. It too s held in place solely by the locating pins. The coupling between the motor M and the rotary brush 34 also is designed to facilitate removal of the rotary brush in this manner. The cover 14 is also provided with openings to receive the locating pin and it too can be swung from its closed to its open position without the necessity for any tools or the like being required to unscrew nuts or other conventional fastening elements Finally, the ball storage means or basket 28 is preferably provided with a vibrator to assure that the balls dumped into the basket will move in a uniform fashion toward the chute means 52 and opening 50 in the cover.

I claim:

1. A ball washer comprising a tank for washing solution, semi-circular track defining means supported in said tank and including fist and second angularly related arcuate track segments defining a juncture for balls travelling along the track in a given direction, said first track segment providing a component of ball movement in one axial direction and said second track segment providing a component of ball movement in the opposite axial direction, said first and second track segments defining said juncture at adjacent portions thereof and casing an abrupt change in direction of ball movement at said juncture, a generally cylindrical brush, means rotatably supporting said brush in said tank so that the brush periphery moves adjacent said track segments to cause the balls to move in said given direction along aid track, a movable semi-circular cover for said tank, said cover defining at least one upper track segment having one end forming a second juncture with another end of said first track segment when said cover in its closed position, said upper track segment providing a component of ball movement in an axial direction opposite that of said first track segment, and means for receiving balls in said first track segment so that the balls are moved by said rotating brush along said track segments and through said junctures.

2. The combination of claim 1 wherein said track segments define a plurality of parallel paths for washing balls that move along said parallel paths and each of said parallel paths having at least two junctures for causing abrupt changes in direction of ball movement.

3. The combination of claim 1 wherein said means rotatably supporting said brush comprises axially spaced journal bearings rotably receiving stub shafts provided in the ends of said brush, locating pin means provided in part on said tank and in part on said journal bearings for removably mounting said brush and bearings on said tank without the use of conventional fasteners.

4. The combination of claim 1 further characterized by locating pin means provided, in part on said tank and in part on said semi-circular track defining means for removably mounting said track defining means in said tank without need of conventional fasteners.

5. The combination of claim 4 wherein said means rotatably supporting said brush comprises axially spaced journal bearings rotatably receiving stub shafts provided in the ends of said brush, said locating pins provided in an upper edge portion of said tank for slidably receiving said track defining means and said journal bearings for removably mounting both said brush and said track defining means without need of conventional fasteners.

6. The combination of claim 5 further characterized by motor means mounted to said tank, and a drive coupling between said motor means and said brush stub shaft, said coupling comprising a drive member and a driven member that are removably coupled to one another and slidably separable from one another.

7. The combination of claim 1 wherein said tank is generally rectangular and upwardly open with opposed upper edge portions, locating pin means in said tank upper edge portions, said semi-circular track defining means including opposed end portions defining openings for receiving said locating pin means.

8. The combination of claim 7 wherein said track defining means includes front and rear portions connecting said opposed end portions thereof, said cover hinged to said rear portion for pivotal movement between open and closed positions, said semi-circular cover including ball storage means provided externally of said cover, and said ball receiving means including an opening in said cover.

9. The combination of claim 8 wherein said ball receiving means further includes an inlet track segment provided in said cover, said inlet track segment having one end communicating with said cover opening and another end communicating with said first track segment at least when said cover is closed.

10. The combination of claim 9 wherein said inlet track segment, and said first and second track segments define a plurality of parallel paths for the balls.

11. The combination of claim 10 wherein said means rotatably supporting said brush comprises axially spaced journal bearings rotatably receiving stub shafts provided in the ends of said brush, said locating pins provided in an upper edge portion of said tank for slidably receiving said track defining means and said journal bearings for removably mounting both said brush and said track defining means without need of conventional fasteners.

12. The combination of claim 11 further characterized by motor means mounted to said tank, and a drive coupling between said motor means and said brush stub shaft, said coupling comprising a drive member and a driven member that are removably coupled to one another and slidably separable from one another.

13. The combination of claim 10 further characterized by chute means adjacent defining said cover opening, said chute means provided between said ball storage means and said one end of said inlet track segment, and inlet guide means provided in said chute means to prevent said balls from blocking said into the individual paths defined by said inlet track segments.

14. The combination of claim 10 wherein said track segments comprise relatively thin plastic vacuum molded sheet material having a helical twist to inpact the above described paths of motion to balls travelling said parallel paths.

15. The combination of claim 14 wherein said track segments have different helical pitch angles so chosen as to accelerate the speed of movement of the balls to separate the balls from one another as they move through these parallel paths.

16. The combination of claim 14 wherein said track segments have a facing of frictional material to cause the balls to rotate or roll as they are moved along said parallel paths by said rotating brush.

17. The combination of claim 14 wherein said brush has outwardly projecting thermoplastic bristles to scrub the balls moving along said track segments.

18. The combination of claim 17 wherein said track segments have different helical pitch angles so chosen as to accelerate the speed of movement of the balls to separate the balls from one another as they move through these parallel paths.

19. The combination of claim 18 wherein said track segments have a facing of frictional material to cause the balls to rotate or roll as they are moved along said parallel paths by said rotating brush.

* * * * *